US007098601B2

(12) United States Patent
Akimoto et al.

(10) Patent No.: US 7,098,601 B2
(45) Date of Patent: Aug. 29, 2006

(54) IMAGE DISPLAY DEVICE

(75) Inventors: Hajime Akimoto, Kokubunji (JP); Naruhiko Kasai, Yokohama (JP); Mitsuhide Miyamoto, Kokubunji (JP)

(73) Assignee: Hitachi, Displays, Ltd., Chiba-Ken (JP)

( * ) Notice: Subject to any disclaimer, the term of this patent is extended or adjusted under 35 U.S.C. 154(b) by 0 days.

(21) Appl. No.: 10/887,888

(22) Filed: Jul. 12, 2004

(65) Prior Publication Data

US 2005/0073260 A1 Apr. 7, 2005

(30) Foreign Application Priority Data

Oct. 3, 2003 (JP) ..... 2003-345316

(51) Int. Cl.
*G09G 3/10* (2006.01)

(52) U.S. Cl. ..... 315/169.1; 315/169.3; 345/92; 345/87

(58) Field of Classification Search ..... 315/169.1
See application file for complete search history.

(56) References Cited

U.S. PATENT DOCUMENTS 6,577,068 B1 * 6/2003 Matsueda ..... 315/169.1
6,628,253 B1 * 9/2003 Hiroki ..... 345/87
6,639,576 B1 * 10/2003 Miyazawa et al. ..... 345/92
6,809,790 B1 * 10/2004 Yamagishi et al. ..... 349/139
6,878,968 B1 * 4/2005 Ohnuma ..... 257/75
6,919,691 B1 * 7/2005 Mizukoshi et al. ..... 315/169.1

FOREIGN PATENT DOCUMENTS

JP 2002-328659 4/2001

OTHER PUBLICATIONS

"A SI type TFT System AM-LCD", Liquid Crystal Display Technologies, in Japanese, pp. 68-70, and English translation, 5 pages.
"ALP249FXX-LCD Module", Sanyo Semiconductor News, No. N7635 in Japanese, 6 pages and English translation, 5 pages.
Battersby, "System on Panel for Mobile Displays", Digest of Technical Papers, AM-LCD'01, pp. 5-8.

* cited by examiner

*Primary Examiner*—Wilson Lee
*Assistant Examiner*—Binh Van Ho
(74) *Attorney, Agent, or Firm*—Reed Smith LLP; Stanley P. Fisher, Esq.; Juan Carlos A. Marquez, Esq.

(57) ABSTRACT

The present invention provides an image display device in which peripheral circuits including a D/A converter are integrated on a glass substrate while realizing high-precision image display. An image display device of the invention has a display area (100) constructed by a plurality of pixels (1). Serial data and commands input from signal lines (s1 and s2) are input to a buffer circuit (10) via an interface circuit (14) and a D/A converter (11). An output of the buffer circuit is input to the horizontal shift register (13) and sequentially scanned and written to the signal line 2. A vertical shift register 8 switches a pixel switch 4 of a pixel to which the image signal is to be written to the on state via a gate line 3, and the pixel displays the optical characteristics according to the written image signal. A buffer circuit made of single crystal Si and a supply voltage-generating circuit (32) for the buffer circuit are provided on an FPC, and other circuits made of polycrystalline Si are provided on the glass substrate 6.

14 Claims, 8 Drawing Sheets

IMAGE DISPLAY DEVICE

CLAIM OF PRIORITY

The present application claims priority from Japanese application serial no. JP 2003-345316, filed on October 3, the content of which is hereby incorporated by reference into this application.

BACKGROUND OF THE INVENTION

1. Field of the Invention

The present invention relates to an image display device in which peripheral circuits can be integrated on a glass substrate and, more particularly, to an image display device suitable for high-precision display.

2. Description of the Prior Arts

Prior arts will be described hereinbelow with reference to FIGS. 6 to 9.

FIG. 6 is a block diagram of an image display device of a first prior art. Pixels 201 are provided in the shape of a matrix in a display area 200, and signal lines 200 and gate lines 203 are connected to the pixels 201. Although a number of pixels 201 are provided in the display area 200 in reality, only one pixel is shown in FIG. 6 for simplification of the drawing. The pixel 201 is constructed by a pixel switch 204 formed by an amorphous Si-TFT (Thin Film Transistor) and a liquid crystal element 205. The display area 200 is provided on a glass substrate 206. An end of the gate line 203 is connected to a shift register (S/R) 208 provided in a gate driver LSI 207 disposed in contact with the glass substrate 206. An end of the signal line 202 is connected to a buffer circuit 210 provided in a liquid crystal driver LSI 209 disposed in contact with the glass substrate 206. The buffer circuit 210 is sequentially connected to a digital/analog converter (hereinbelow, called "D/A converter") 211, a latch circuit 212, and a shift register 213. The shift register 213 is connected to a not-shown external terminal via an interface circuit (I/F) 214 and a signal line "s".

Next, the operation of the first prior art shown in FIG. 6 will be described. Image data input from the external terminal to the liquid crystal driver LSI 209 via the signal line "s" and the interface circuit 214 is written into the latch circuit 212 provided for each column via the shift register 213. The latch circuit 212 inputs the written image data to the D/A converter 211 on the row unit basis. An image signal voltage output from the D/A converter 211 is written into the signal line 202 provided for the glass substrate 206 via the buffer circuit 210. The shift register circuit 208 provided in the gate driver LSI 207 switches the pixel switch 204 to which the image signal voltage is to be written to the on state via the predetermined gate line 203. In such a manner, the predetermined image signal voltage is written into the liquid crystal element 205 of the pixel selected. After that, the liquid crystal element 205 displays optical characteristics according to the written image signal voltage, thereby displaying a predetermined image in the display area 200.

Such a prior art is used for a most common product at present in a general amorphous Si-TFT display and is disclosed in, for example, "Liquid Display Technique" written and compiled by Shoichi Matsumoto, Sangyo Tosho, 1996; pp. 68–70 (non-patent document 1).

To improve the first prior art, the following technique has been researched and developed in recent years. In the first prior art, the amorphous Si-TFT is provided on the glass substrate 206 and, in order to integrate circuit elements other than the pixel switch 204 on the same substrate, a peripheral LSI chip has to be mounted, so that the cost is high.

In contrast, in the following second prior art, a polycrystalline Si-TFT is provided on the glass substrate 206, so that not only the pixel switch 204 but also peripheral driving circuits which are conventionally integrated to the gate driver LSI 207 and the liquid crystal driver LSI 209 can be integrated on the same glass substrate 206.

FIG. 7 is a block diagram of an image display device of a second prior art. In the display area 200, the pixels 201 are provided in the shape of a matrix. To the pixel 201, the signal line 202 and the gate line 203 are connected. Although a number of pixels 201 are provided in the display area 200 in reality, for simplicity of the drawing, only one pixel is shown in FIG. 7. The pixel 201 is constructed by a pixel switch 204P formed by a polycrystalline Si-TFT and the liquid crystal element 205. The display area 200 is provided on the glass substrate 206. An end of the gate line 203 is connected to a shift register 208P commonly provided on the glass substrate 206. The shift register 208P is also formed by a polycrystalline Si-TFT. An end of the signal line 202 is connected to a buffer circuit 210P commonly provided on the glass substrate 206. The buffer circuit 210P is sequentially connected to a D/A converter 211P, a latch circuit 212P, and a shift register 213P. The shift register 213P is connected to a not-shown external terminal via the interface circuit 214 provided on the outside of the glass substrate 206 as a single crystal Si-LSI and the signal line "s". Each of the buffer circuit 210P, D/A converter 211P, latch circuit 212P, and shift register circuit 213P is formed by a polycrystalline Si-TFT.

Next, the operation of the second prior art shown in FIG. 7 will be described. Image data input from the external terminal via the signal line "s" is input to the glass substrate 206 via the interface circuit 214 provided as a single crystal Si-LSI and written into the latch circuit 212P provided for each column via the shift register 213P. The latch circuit 212P inputs the written image data to the D/A converter 211P on the row unit basis. An image signal voltage which is output from the D/A converter 211 is written into the signal line 202 via the buffer circuit 210P. At this time, the shift register 208P switches the pixel switch 204P in a pixel row to which the image signal voltage is to be written to the on state via the predetermined gate line 203. In such a manner, the predetermined image signal voltage is written into the liquid crystal element 205 of the pixel selected. After that, the liquid crystal element 205 displays optical characteristics according to the written image signal voltage, thereby displaying a predetermined image in the display area 200.

The second prior art has advantages such that, as compared with the first prior art, the peripheral LSIs such as the gate driver LSI 207 and the liquid crystal driver LSI 209 can be reduced and the number of output terminals of the glass substrate 206 can be reduced. Consequently, the second prior art is being researched and developed vigorously in recent years. Such a prior art is specifically described in, for example, Japanese Unexamined Patent Publication No. 2002-328659 (Patent Document 1).

It can be said that the second prior art aims at reduction of the peripheral LSIs by forming the functions of the peripheral LSIs of a liquid crystal display on the same glass substrate 206 as that in the liquid crystal display by using polycrystalline Si-TFT.

Further, on an extension of the idea, the following third prior art is being studied recently. In the second prior art, the peripheral drive LSIs are integrated on the glass substrate 206. The third prior art aims at integration of even a peripheral system onto the same glass substrate 206 by using polycrystalline Si-TFTs.

FIG. 8 is a block diagram of an image display device of the third prior art. In the display area 200, the pixels 201 are provided in the shape of a matrix. To the pixels 201, the signal lines 202 and the gate lines 203 are connected. Although a number of pixels 201 are provided in the display area 200 in reality, for simplicity of the drawing, only one pixel is shown in FIG. 8. The pixel 201 is constructed by the pixel switch 204P formed by a polycrystalline Si-TFT and the liquid crystal element 205. The display area 200 is provided on the glass substrate 206. An end of the gate line 203 is connected to the shift register circuit 208P commonly provided on the glass substrate 206. The shift register circuit 208P is also formed by a polycrystalline Si-TFT. An end of the signal line 202 is connected to a driver circuit (DRV) 220 provided for the glass substrate 206. The driver circuit 220 includes the buffer circuit 210P, D/A converter 211P, latch circuit 212P, and shift register circuit 213P which are provided in the second prior art and corresponds to the liquid crystal driver LSI 209 in the first prior art. The driver circuit 220 is further connected to a frame memory (FMEM) 222 and a CPU 223 via a timing controller (T-CTL) 221. Moreover, a supply voltage-generating circuit 224 is formed on the glass substrate 206 by using a polycrystalline Si-TFT in a manner similar to the driver circuit 220, timing controller 221, frame memory 222, and CPU 223.

Next, the operation of the third prior art shown in FIG. 8 will be described. Image data which is read from the frame memory 222 under control of the CPU 223 is written into the driver circuit 220 via the timing controller 221. The driver circuit 220 converts the image data into an image signal voltage and writes the image signal voltage to the signal line 202 at a predetermined timing. At the same time, the timing controller 221 controls the shift register 208P. The shift register 208P switches the pixel switch 204P in a pixel row to which the image signal voltage is to be written to the on state via the predetermined gate line 203. In such a manner, the predetermined image signal voltage is written into the liquid crystal element 205 of the pixel 201 selected. After that, the liquid crystal element 205 displays optical characteristics according to the written image signal voltage, thereby displaying a predetermined image in the display area 200.

The third prior art has advantages such that, as compared with the second prior art, the peripheral mounting system such as the timing controller 221, frame memory 222, CPU 223, and supply voltage-generating circuit 224 can be also reduced, and is generally called a system-in display technique. Such a prior art is described in, for example, "Digest of Technical Papers, AM-LCD, '01, "System on Panel for Mobile Displays", pp. 5–8) (Non-Patent Document 2).

In each of the foregoing prior arts, the advantages obtained by forming the polycrystalline Si-TFTs on the glass substrate are used for reducing the peripheral LSIs and the peripheral mounting system. Another technique of using the polycrystalline Si-TFT will be described as a fourth prior art. The fourth prior art is a technique used for, for example, a view finder of a digital still camera of a relatively small number of pixels and is directed to simplify the liquid crystal driver LSI in the first prior art.

FIG. 9 is a block diagram of an image display device of a fourth prior art. In the display area 200, the pixels 201 are provided in the shape of a matrix. To the pixels 201, the signal lines 202 and the gate lines 203 are connected. Although a number of pixels 201 are provided in the display area 200 in reality, for simplicity of the drawing, only one pixel is shown in FIG. 9. The pixel 201 is constructed by the pixel switch 204P formed by a polycrystalline Si-TFT and the liquid crystal element 205. The display area 200 is provided on the glass substrate 206. An end of the gate line 203 is connected to the shift register 208P commonly provided for the glass substrate 206. The shift register 208P is also formed by a polycrystalline Si-TFT. An end of the signal line 202 is connected to the shift register 213P formed by using a polycrystalline Si-TFT on the glass substrate 206. The shift register circuit 213P is connected to a not-shown external terminal via the buffer circuit 210, D/A converter 211, interface circuit 214, and signal line "s" which are formed by using single crystal Si on the outside of the glass substrate 206.

Next, the operation of the fourth prior art shown in FIG. 9 will be described. Image data input from the external terminal via the signal line "s" and the interface circuit 214 to the D/A converter 211 is converted to an image signal voltage and is input to the shift register 213P provided for the glass substrate 206 via the buffer circuit 210. The shift register 213P writes the image signal voltage to the signal line 202 provided for each column. At this time, the shift register 208P switches the pixel switch 204P in a pixel row to which the image signal voltage is to be written to the on state via the predetermined gate line 203. In such a manner, the predetermined image signal voltage is written into the liquid crystal element 205 of the pixel selected. The liquid crystal element 205 displays optical characteristics according to the written image signal voltage, thereby displaying a predetermined image in the display area 200.

Such a prior art is a technique different from the second prior art aiming at simplification of the liquid crystal driver LSI in the first prior art as described above and is used for, particularly, a display having a small number of pixels. The prior art is disclosed in, for example, Sanyo Semiconductor News of Sanyo Electric, No. N7635, "ALP249FXX-LCD module" (Non-Patent Document 3).

SUMMARY OF THE INVENTION

As described above, the polycrystalline Si-TFT technique is being developed on the basis of the idea of providing the peripheral drive LSIs and the peripheral mounting system like the second and third prior arts different from the amorphous Si-TFT technique of the first prior art.

However, we have found that the conventional idea of replacing all of LSIs with polycrystalline Si-TFTs has a serious problem.

To replace all of the LSIs with polycrystalline Si-TFTs, all of circuits to be provided on the glass substrate have to be formed by using the polycrystalline Si-TFT technique. However, a crystalline interface exists in the channel in the polycrystalline Si-TFT, so that the characteristics of transistors always vary. The characteristic variations in the transistors do not cause a problem in a circuit which can be constructed only by a digital circuit and a switch but occur in an analog circuit. In this case, a problem is variations in the buffer circuit 210P. Since variations in the buffer circuit 210P cause noises of a fixed pattern of vertical stripes in a display image, at the time of displaying a high-precision image, this is a fatal problem.

Considering this point, it is understood that it is difficult to realize high-precision image display such as 8-bit display by the second or third prior art. On an extension of the first or fourth prior art, peripheral circuits including a D/A converter requested to perform high-speed operation, other than the shift register circuit cannot be integrated on a glass substrate.

An object of the invention is therefore to provide an image display device in which peripheral circuits including a D/A converter are integrated on a glass substrate while realizing high-precision image display such as 8-bit display.

An example of representative means of an image display device according to the invention will be described as follows. The invention provides an image display device including: a display part constructed by a plurality of pixels provided on an insulating substrate; display signal voltage writing means including a signal line for applying a display signal voltage to the pixel; and signal voltage generating means for generating the display signal voltage from digital display signal data, wherein the signal voltage generating means includes D/A converting means and impedance converting means for an output voltage of the D/A converting means, the D/A converting means is formed on the insulating substrate, and the impedance converting means is formed on a semiconductor substrate.

Preferably, the impedance converting means is constructed by a buffer circuit whose component element is a MOS transistor made of single crystal Si. Further, the impedance converting means may include a differential amplification circuit having negative feedback.

The idea of forming the impedance converting means which is sensitive to variation in characteristics on a semiconductor substrate which is on the outside of an, insulating substrate (for example, glass substrate) on which the display part and peripheral circuits are provided while forming the D/A converting means on the insulating substrate is quite different from the idea of the second and third prior arts.

According to the invention, by forming the D/A converting means on the insulating substrate on which the pixel part is also formed and forming the impedance converting means on the semiconductor substrate, a low-priced image display device capable of performing high-precision display can be provided.

DETAILED DESCRIPTION OF THE PREFERRED EMBODIMENTS

Embodiments of the invention will be described in detail hereinbelow with reference to the attached drawings.

First Embodiment

Figure 1:
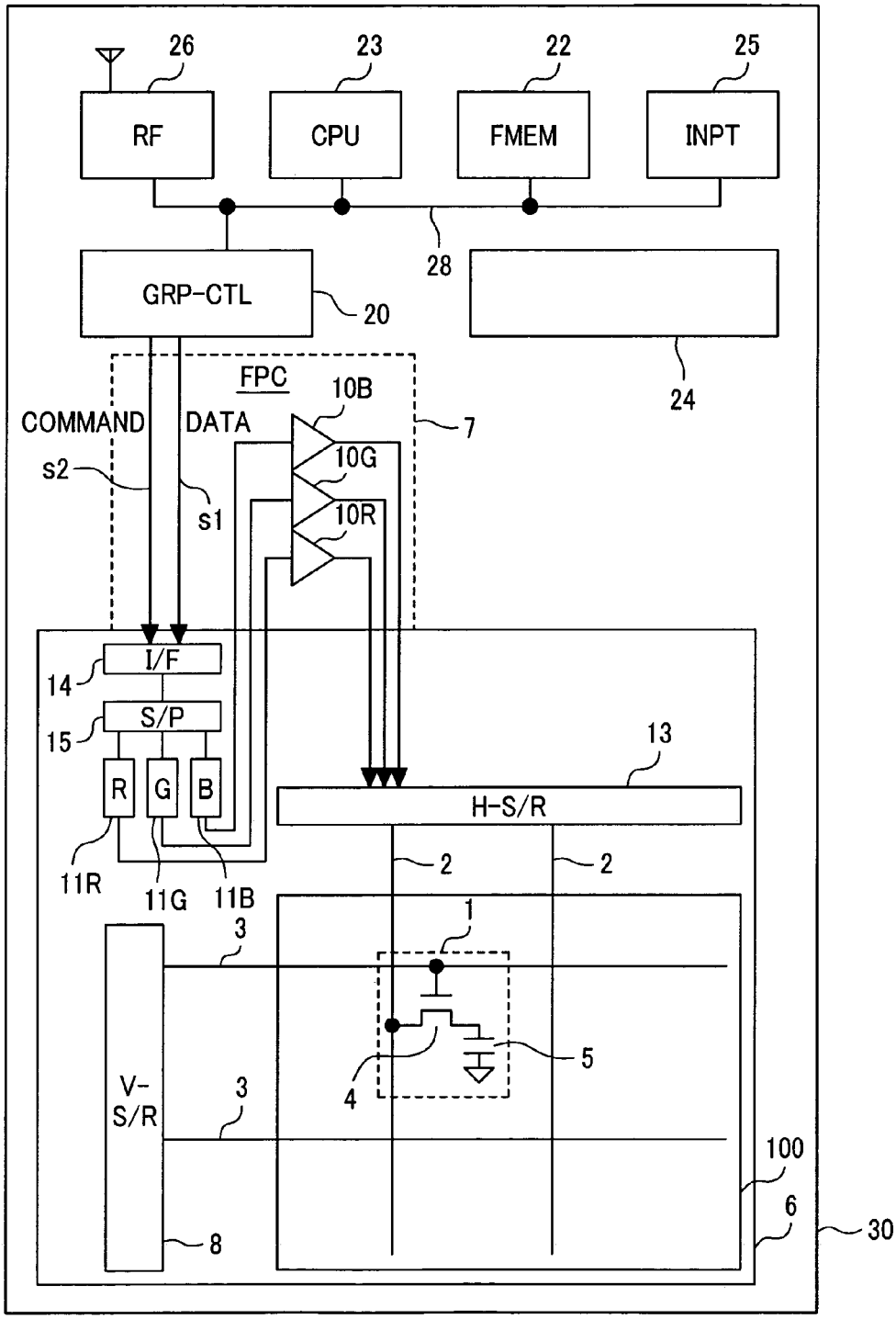
FIG. 1 is a block diagram of a personal digital assistance as a first embodiment of the invention.

A general configuration and operation of a first embodiment of an image display device according to the invention will be described. FIG. 1 is a diagram showing the first embodiment of the invention and is a block diagram showing a case where the invention is applied to a personal digital assistance. Pixels 1 are provided in the shape of a matrix in a display area 100, and signal lines 2 and gate lines 3 are connected to the pixels 1. Although a number of pixels 1 are provided in the display area 100 in reality, only one pixel is shown in FIG. 1 for simplification of the drawing.

The pixel 1 is constructed by a pixel switch 4 formed by a polycrystalline Si-TFT and a liquid crystal element 5. The display area 100 is provided on a glass substrate 6. An end of the gate line 3 is connected to a vertical shift register (V-S/R) 8 provided on the glass substrate 6. The vertical shift register 8 is also formed by a polycrystalline Si-TFT. An end of the signal line 2 is connected to a horizontal shift register (H-S/R) 13 provided on the glass substrate 6. An input terminal of the horizontal shift register 13 is divided into three channels for R, G, and B (red, green, and blue) which are connected to three buffer circuits 10R, 10G, and 10B, respectively, mounted on an FPC (Flexible Plastic Cable) 7 connected to the outside of the glass substrate 6.

Input terminals of the three buffer circuits 10R, 10G, and 10B extend onto the glass substrate 6 and are connected to a serial/parallel converter (S/P) 15 via D/A converters 11R, 11G, and 11B, respectively, and further connected to an interface circuit 14. The three buffer circuits 10R, 10G, and 10B are IC circuits constructed by MOS transistors formed on a single crystal Si substrate. On the other hand, the D/A converters 11R, 11G, and 11B, serial/parallel converter 15, and interface circuit 14 are formed by polycrystalline Si-TFTs on the glass substrate 6.

Data and commands are serially input from a graphic controller (GRP-CTL) 20 provided on the outside of the glass substrate 6 to the interface circuit 14 via a data signal line s1 and a command signal line 2*s* in the FPC 7. The graphic controller 20 is connected to a frame memory 22, a CPU 23, input means (INPT) 25 constructed by a switch and a touch panel and a radio-signal processor (RF) 26. In a personal digital assistance 30, a power-supply circuit 24 including a secondary battery is mounted and supplies a predetermined power to each of the circuits. The graphic controller 20, frame memory 22, CPU 23, input means 25, radio-signal processor 26, and power-supply circuit 24 are realized by using IC circuits constructed by MOS transistors formed on a single crystal Si substrate.

The operation of the first embodiment shown in FIG. 1 will now be described.

When a predetermined command is input from the input means 25 to the CPU 23, according to the command, the CPU 23 operates the radio-signal processor 26, frame memory 22, and power-supply circuit 24 and transfers necessary commands and display data to the graphic controller 20. The graphic controller 20 inputs a predetermined command and display data to the interface circuit 14 provided on the glass substrate 6. The interface circuit 14 converts the signals to predetermined voltages for the polycrystalline Si-TFT circuit, transfers a timing clock to each of the circuits provided on the glass substrate 6, and transfers display data to the serial/parallel converter 15. The serial/parallel converter 15 decomposes the transferred display data into three parallel signals of R, G, and B (Red, Green, and Blue) and sequentially inputs the display data to the D/A converters 11R, 11G, and 11B, respectively.

Next, the D/A converters 11R, 11G, and 11B sequentially convert input digital display data to analog image signal voltages and inputs the image signal voltages to the three buffer circuits 10R, 10G, and 10B mounted on the FPC 7 connected on the outside of the glass substrate 6.

The buffer circuits 10R, 10G, and 10B perform impedance conversion on the input image signal voltages and sequentially input the image signal voltages again to the horizontal shift register 13 on the glass substrate 6, and the horizontal shift register 13 sequentially scans and writes the image signal voltage onto the signal line 2. At this time, the vertical shift register 8 switches the pixel switch 4 in a pixel row to which the image signal voltage is to be written to the on state via the predetermined gate line 3, thereby writing a predetermined image signal voltage to the liquid crystal element 5 of the selected pixel. After that, the liquid crystal element 5 displays the optical characteristics according to the written image signal voltage and a predetermined image is displayed in the display area 100.

Figure 2:
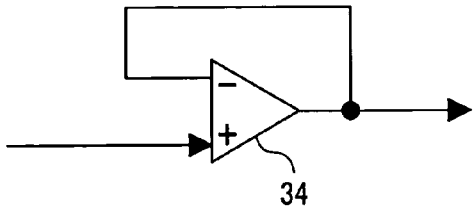
FIG. 2 is a basic circuit block diagram of a single buffer circuit in the first embodiment.

It has been described that the three buffer circuits 10R, 10G, and 10B are IC circuits constructed by MOS transistors formed on the single crystal Si substrates. FIG. 2 shows the configuration of each of the buffer circuits.

FIG. 2 shows a basic circuit configuration of the single buffer circuit 10 which is realized as a voltage follower circuit for applying a negative feedback to an operational amplifier 31 having a pair of differential inputs. Since the circuit configuration of the operational amplifier 31 is a well-known common one, the details will not be described here.

Since the three buffer circuits 10R, 10G, and 10B are provided independently as described above, the embodiment has an advantage such that the color balance of RGB is easily adjusted. Since the buffer circuits are provided on the FPC 7, there is also an advantage such that mounting of internal elements of the personal digital assistance 30 is facilitated.

The foregoing embodiment can be variously modified without departing from the gist of the invention. For example, although a glass substrate is used as a TFT substrate, instead, another transparent insulating substrate such as a quartz substrate or a transparent plastic substrate may be used. By employing a structure of a reflection type for the liquid crystal element 5, an opaque substrate may be used.

In the embodiment, all of the three buffer circuits 10R, 10G, and 10B are mounted on the FPC 7 connected on the outside of the glass substrate 6. However, the mounting form of the three buffer circuits 10R, 10G, and 10B is not limited to the above. Obviously, the buffer circuits 10R, 10G, and 10B can be directly mounted on the glass substrate 6 by COG (Chip On Glass) mounting or mounted on a common circuit substrate or in another IC chip or package.

In the description of the embodiment, intentionally, the number of pixels, the panel size, and the like are not referred to because the invention is not limited to the specifications and formats. Although the display signal has 256 grades (8 bits) in the foregoing embodiment, the higher grades can be also used. On the contrary, it is easy to reduce the gradation precision. By using the invention, the precision of the image signal voltage can be easily improved.

Basically, the various changes and the like are not limited to the foregoing embodiment but can be similarly made also in the following embodiments.

Second Embodiment

Figure 3:
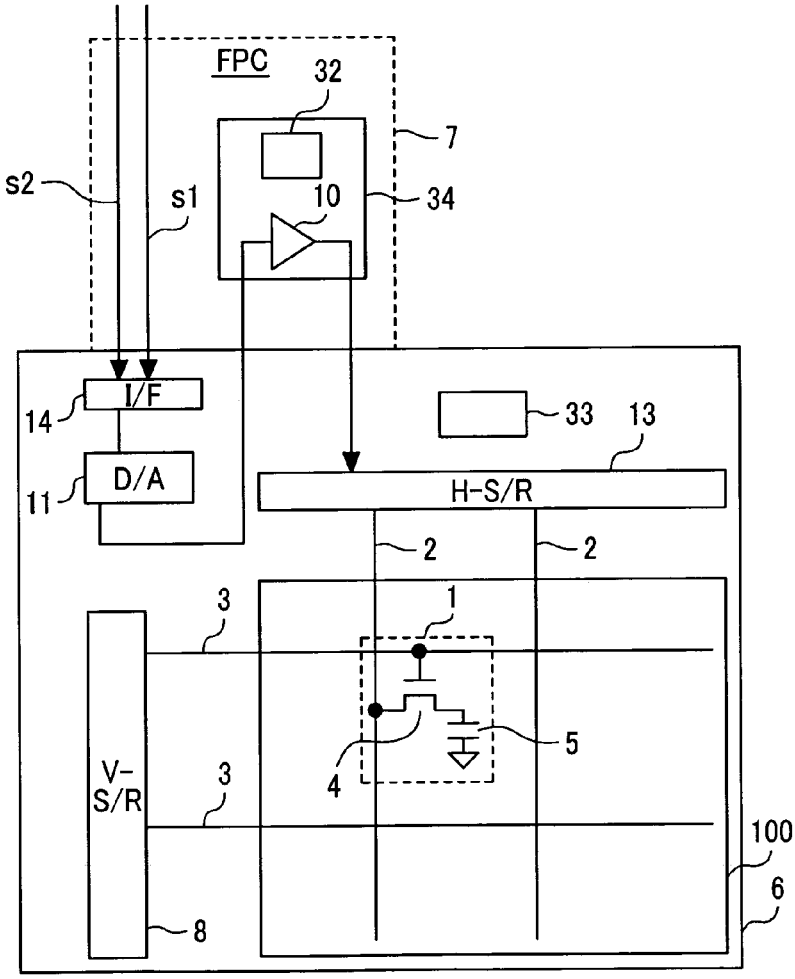
FIG. 3 is a block diagram of a liquid crystal display panel of a second embodiment of the invention.

A second embodiment of an image display device according to the invention will be described. FIG. 3 is a diagram showing the second embodiment of the invention and is a block diagram showing a case where the invention is applied to a liquid crystal display panel. The pixels 1 are provided in the shape of a matrix in the display area 100, and the signal lines 2 and gate lines 3 are connected to the pixels 1. Although a number of pixels 1 are provided in the display area 100 in reality, only one pixel is shown in FIG. 3 for simplification of the drawing.

The pixel 1 is constructed by a pixel switch 4 formed by a polycrystalline Si-TFT and a liquid crystal element 5. The display area 100 is provided on the glass substrate 6. An end of the gate line 3 is connected to the vertical shift register 8 provided on the glass substrate 6. The vertical shift register 8 is also form by a polycrystalline Si-TFT.

An end of the signal line 2 is connected to the horizontal shift register 13 provided on the glass substrate 6. An input terminal of the horizontal shift register 13 is connected to the buffer circuit 10 mounted on the FPC 7 connected to the outside of the glass substrate 6. Further, input terminal of the buffer circuit 10 extends onto the glass substrate 6 and is connected via D/A converter 11 to the interface circuit 14. The buffer circuit 10 is an IC circuit constructed by MOS transistors formed on a single crystal Si substrate. On the same IC 34 mounted on the FPC, a buffer circuit power supply generating circuit 32 is provided.

The D/A converter 11 and the interface circuit 14 are formed by polycrystalline Si-TFTs on the glass substrate 6. Data and commands are input from the outside of the glass substrate 6 to the interface circuit 14 via the data signal line s1 and the command signal line 2*s* on the FPC 7. On the glass substrate 6, a negative-voltage and high-voltage power supply generating circuit 33 formed by a polycrystalline Si-TFT is further provided.

The operation of the second embodiment shown in FIG. 3 will now be described.

When a predetermined command and display data are input from the outside to the interface circuit 14 provided on the glass substrate 6 via the signal lines s1 and s2 in the FPC 7, the interface circuit 14 converts the signals to predetermined voltages directed to the polycrystalline Si-TFT circuit, transfers a timing clock to each of the circuits provided on the glass substrate 6, and sequentially transfers display data to the D/A converter 11.

Next, the D/A converter 11 sequentially converts the received digital display data to analog image signal voltages and inputs the image signal voltages to the buffer circuit 10 on the IC 34 mounted on the FPC 7 connected on the outside of the glass substrate 6. The buffer circuit 10 performs impedance conversion on the input image signal voltages and, after that, sequentially inputs the image signal voltages again to the horizontal shift register 13 on the glass substrate 6. The horizontal shift register 13 sequentially scans and writes the image signal voltage onto the signal line 2. At this time, the vertical shift register 8 switches the pixel switch 4 in a pixel row to which the image signal voltage is to be written to the on state via the predetermined gate line 3, thereby writing a predetermined image signal voltage to the liquid crystal element 5 of the selected pixel. After that, the liquid crystal element 5 displays the optical characteristics according to the written image signal voltage and a predetermined image is displayed in the display area 100.

In the embodiment, the buffer circuit 10 operates on the output power of the buffer circuit power supply generating circuit 32 provided for the IC 34 mounted on the FPC. On the other hand, the horizontal shift register 13 and the vertical shift register 8 operate by the negative-voltage and high-voltage power supply generating circuit 33 provided on the glass substrate 6. In such a manner, in the embodiment, the burden on the power-supply circuit 34 mounted on the outside of the liquid crystal display panel can be reduced.

The buffer circuit power supply generating circuit 32 using the single crystal Si-MOS transistor is provided on the IC 34 mounted on the FPC 7 and the negative-voltage and high-voltage power supply generating circuit 33 using the polycrystalline Si-TFT is provided on the glass substrate 6 for the following reasons. The buffer circuit 10 has to write the predetermined image signal voltage with high precision to the liquid crystal element 5, so that a high-precision power source having high current supply capability is necessary. Consequently, it is preferable to provide the buffer circuit power supply generating circuit 32 by using the single crystal Si-MOS transistor. The horizontal shift register 13 and the vertical shift register 8 need relatively large voltage amplitudes and negative voltages for tuning on/off the image signal voltage. It is consequently preferable to provide the negative-voltage and high-voltage power supply generating circuit 33 by using the polycrystalline Si-TFT in which the substrate is insulated.

Third Embodiment

Figure 4:
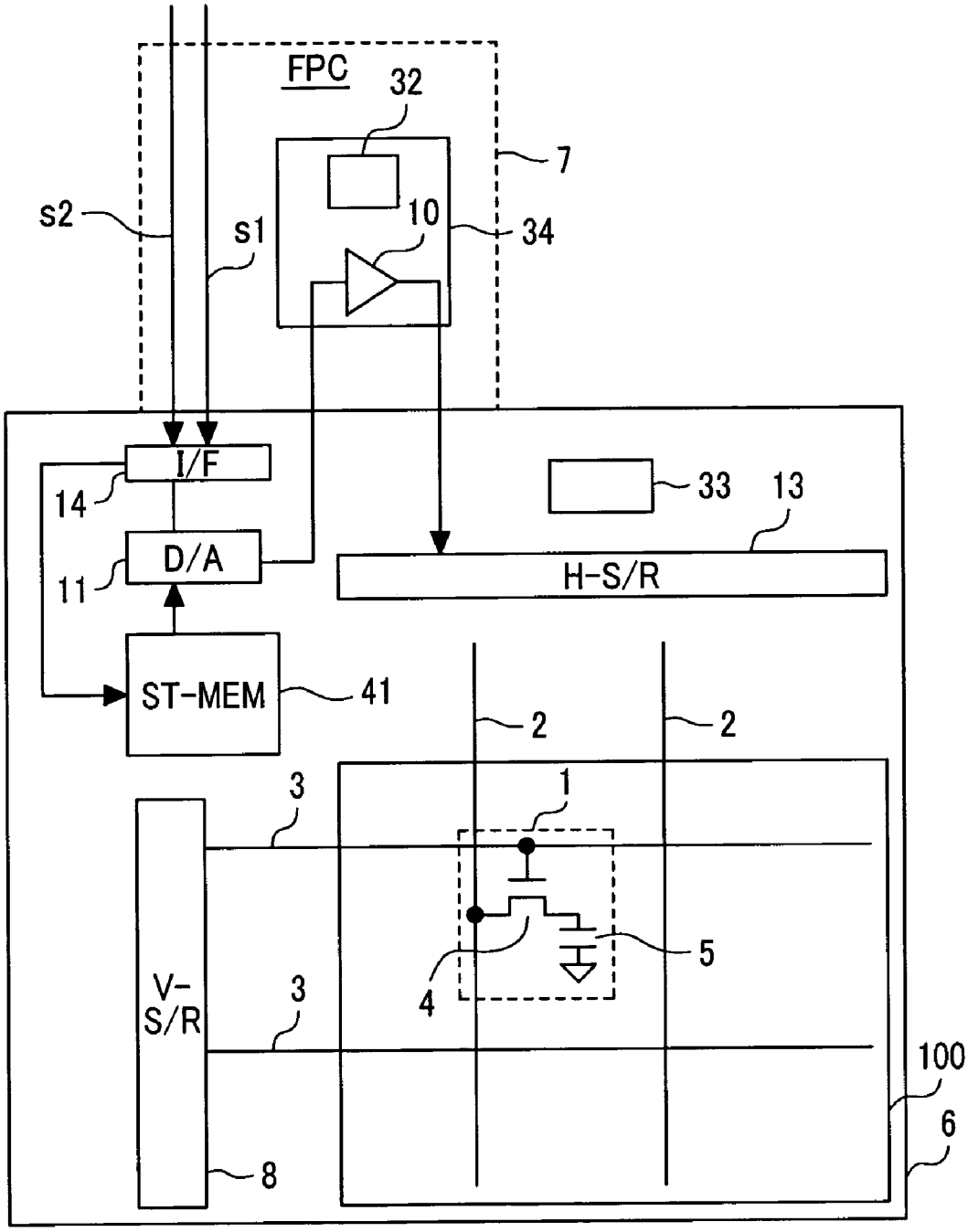
FIG. 4 is a block diagram of a liquid crystal display panel of a third embodiment of the invention.

A third embodiment of the image display device according to the invention will be described. FIG. 4 is a block diagram of a liquid crystal display panel of the third embodiment of the image display device according to the invention. The third embodiment is different from the second embodiment with respect to the point that a frame memory (ST-FMEM) 41 for still image is formed by a polycrystalline Si-TFT on the glass substrate 6. Since the frame memory 41 for still image employs an SRAM configuration which is generally well known, its structure will not be described but only the operation of the part will be described in detail hereinbelow.

When a predetermined command and display data are input from the outside to the interface circuit 14 provided on the glass substrate 6 via the signal lines s1 and s2 on the FPC 7, the interface circuit 14 converts the signals to predetermined voltages directed to the polycrystalline Si-TFT circuit, transfers a timing clock to each of the circuits provided on the glass substrate 6, and sequentially transfers display data to the D/A converter 11. In the case where a command for storing display data is input at this time, the interface circuit 14 inputs display data not to the D/A converter 11 but to the frame memory 41 for still image. The frame memory 41 for still image stores the display data as a still image.

The display data stored in the frame memory 41 for still image is not used for display. However, it is used for display by the following procedure when an external device enters a sleep mode for energy saving.

In the case where an external device enters the sleep mode for energy saving, predetermined commands and display data are not basically input to a liquid crystal display panel from the outside. Instead, prior to this, a command for displaying a still image by using the frame memory 41 for still image is input to the interface circuit 14 from the outside. On receipt of the command, the frame memory 41 for still image starts repeatedly inputting display data to the D/A converter 11. The image display after this is performed in a manner similar to the case where the frame memory 41 for still image is not used.

Specifically, the D/A converter 11 sequentially converts input digital display data to analog image signal voltages and inputs the image signal voltages to the buffer circuit 10 of the IC 34 mounted on the FPC 7 connected on the outside of the glass substrate 6. The buffer circuit 10 performs impedance conversion on the input image signal voltages and, after that, sequentially inputs the image signal voltages again to the horizontal shift register 13 on the glass substrate 6. The horizontal shift register 13 sequentially scans and writes the image signal voltage onto the signal line 2. At this time, the vertical shift register 8 switches the pixel switch 4 in a pixel row to which the image signal voltage is to be written to the on state via the predetermined gate line 3, thereby writing a predetermined image signal voltage to the liquid crystal element 5 of the selected pixel. After that, the liquid crystal element 5 displays the optical characteristics according to the written image signal voltage and a predetermined image is displayed in the display area 100.

The third embodiment has an advantage such that, by using the frame memory 41 for still image, a still image can be displayed also in the case where an external device enters the sleep mode for energy saving. The liquid crystal display panel can operate only by output power of the buffer-circuit power supply generating circuit 32 and output power of the negative-voltage and high-voltage power supply generating circuit 33 provided on the glass substrate 6. From the viewpoint of energy saving, desirably, the liquid crystal element 5 performs displaying of a reflection mode.

Fourth Embodiment

Figure 5:
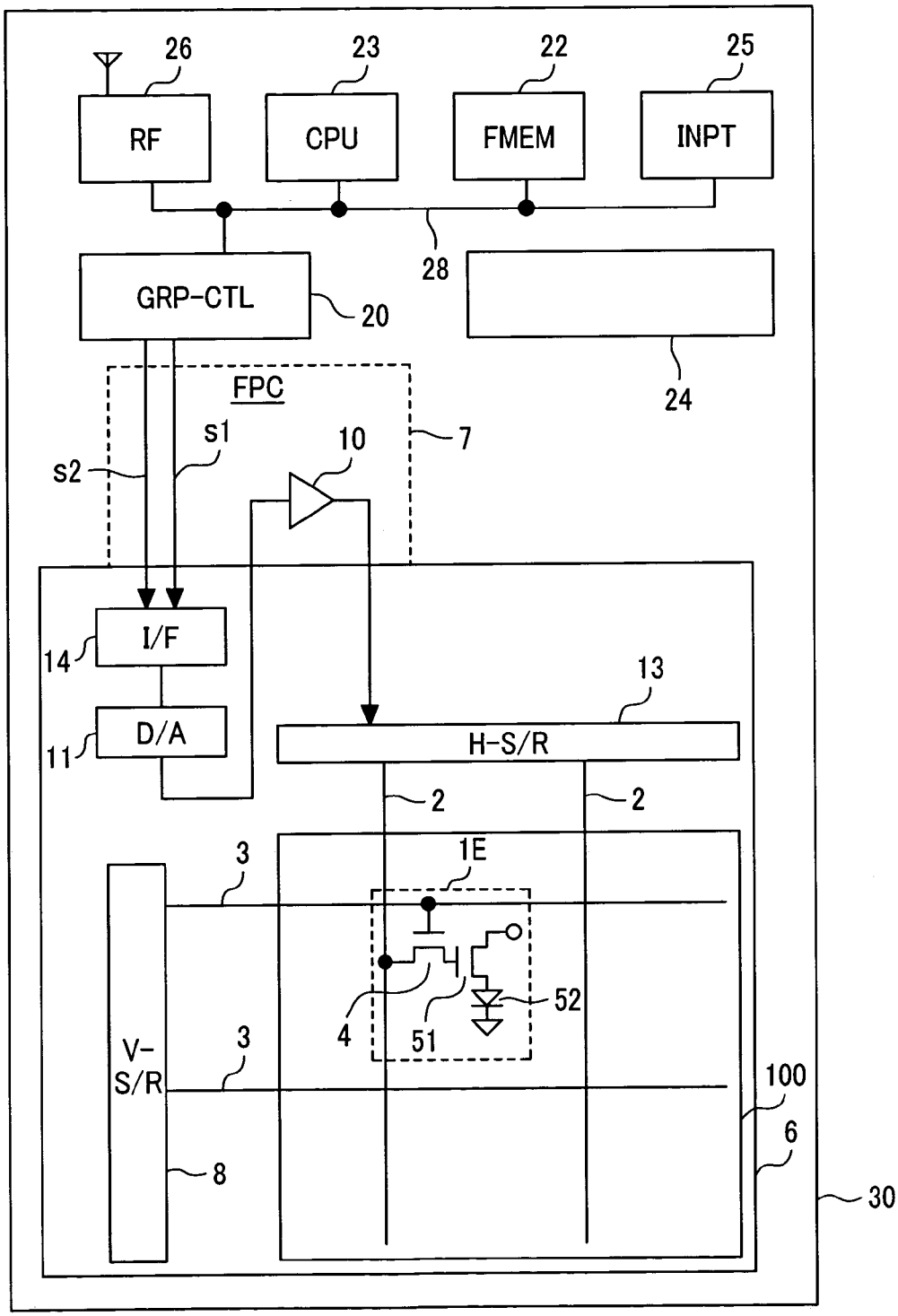
FIG. 5 is a block diagram of a personal digital assistance as a fourth embodiment of the invention.
Figure 6:
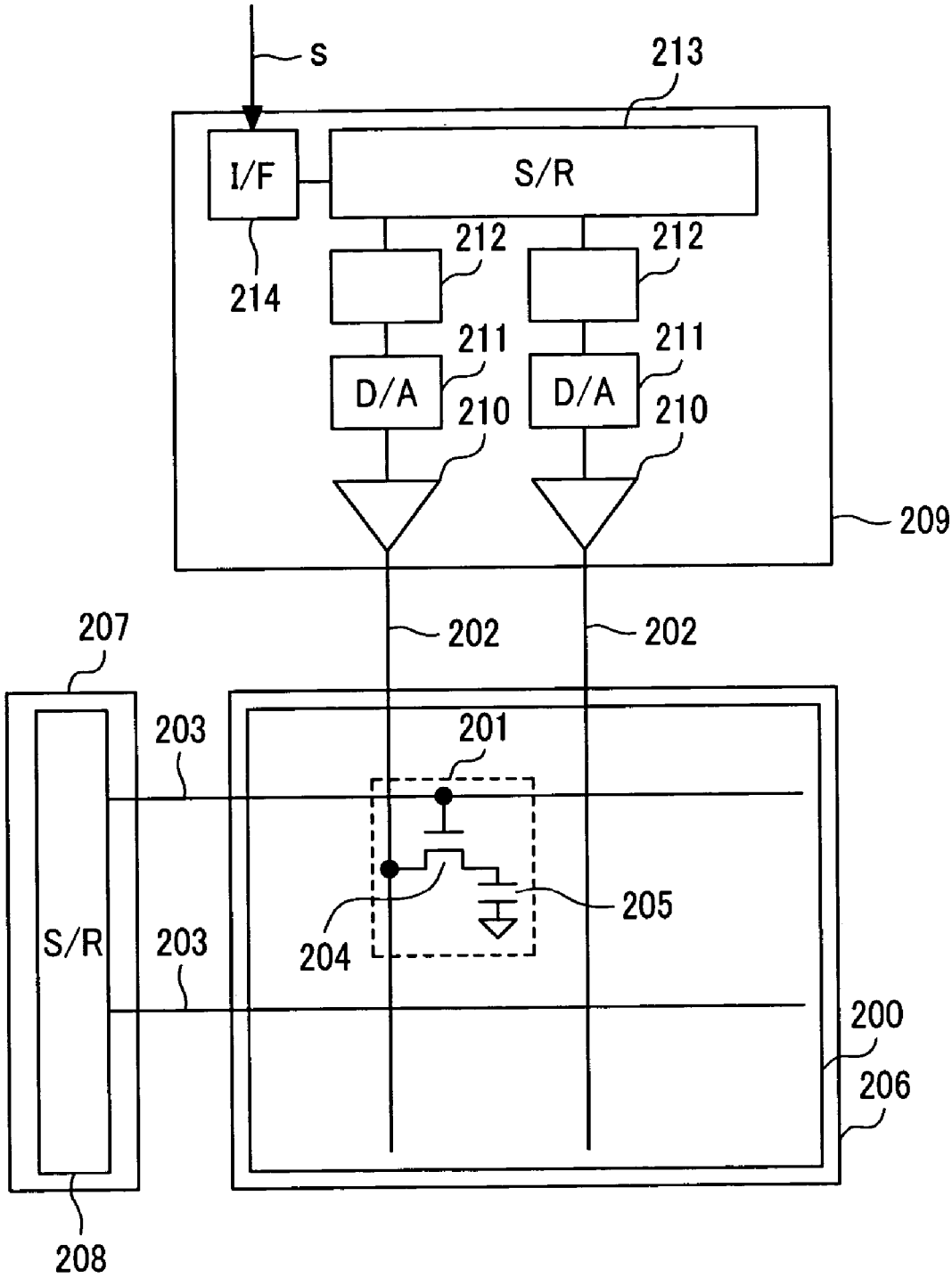
FIG. 6 is a block diagram of an image display device of a first prior art.
Figure 7:
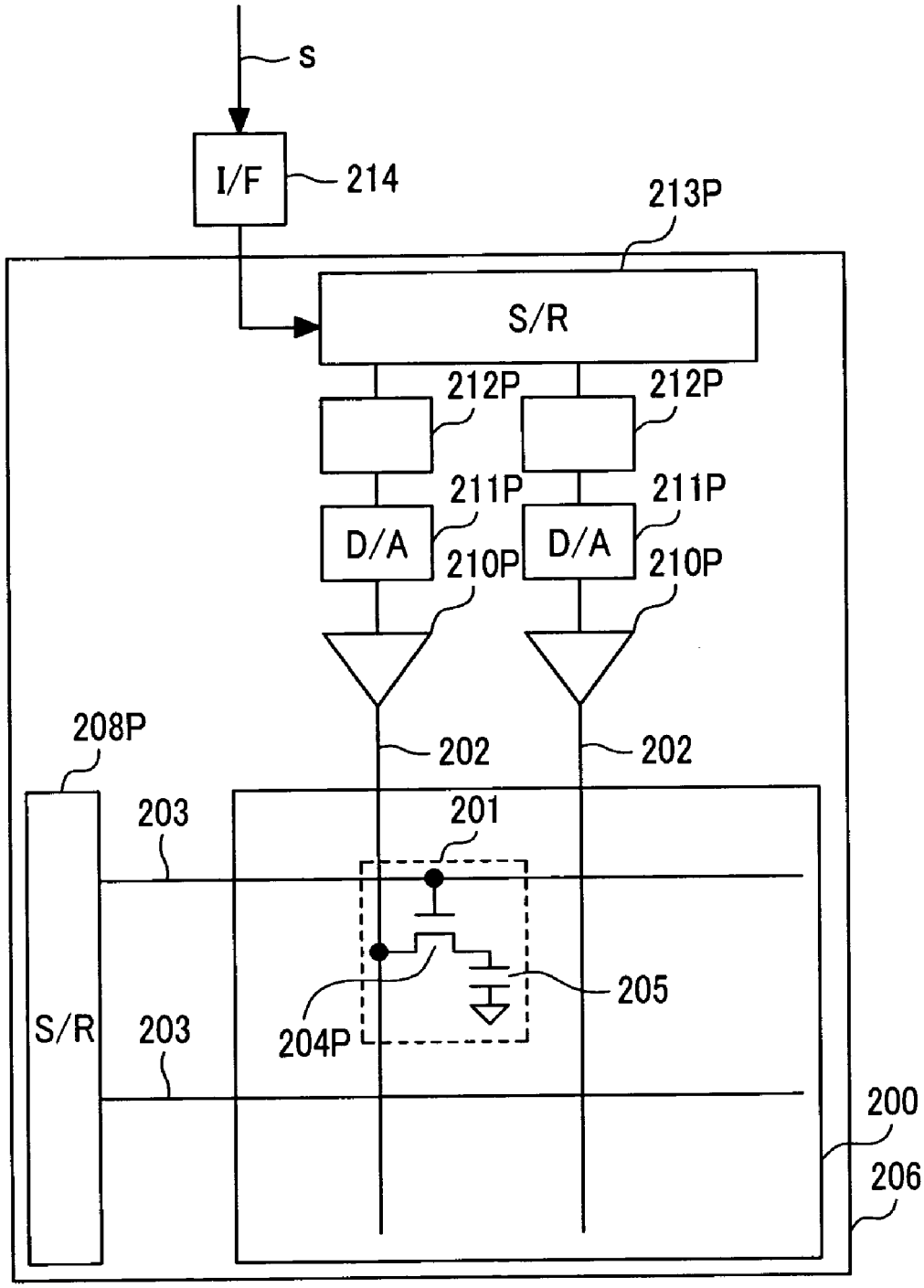
FIG. 7 is a block diagram of an image display device of a second prior art.
Figure 8:
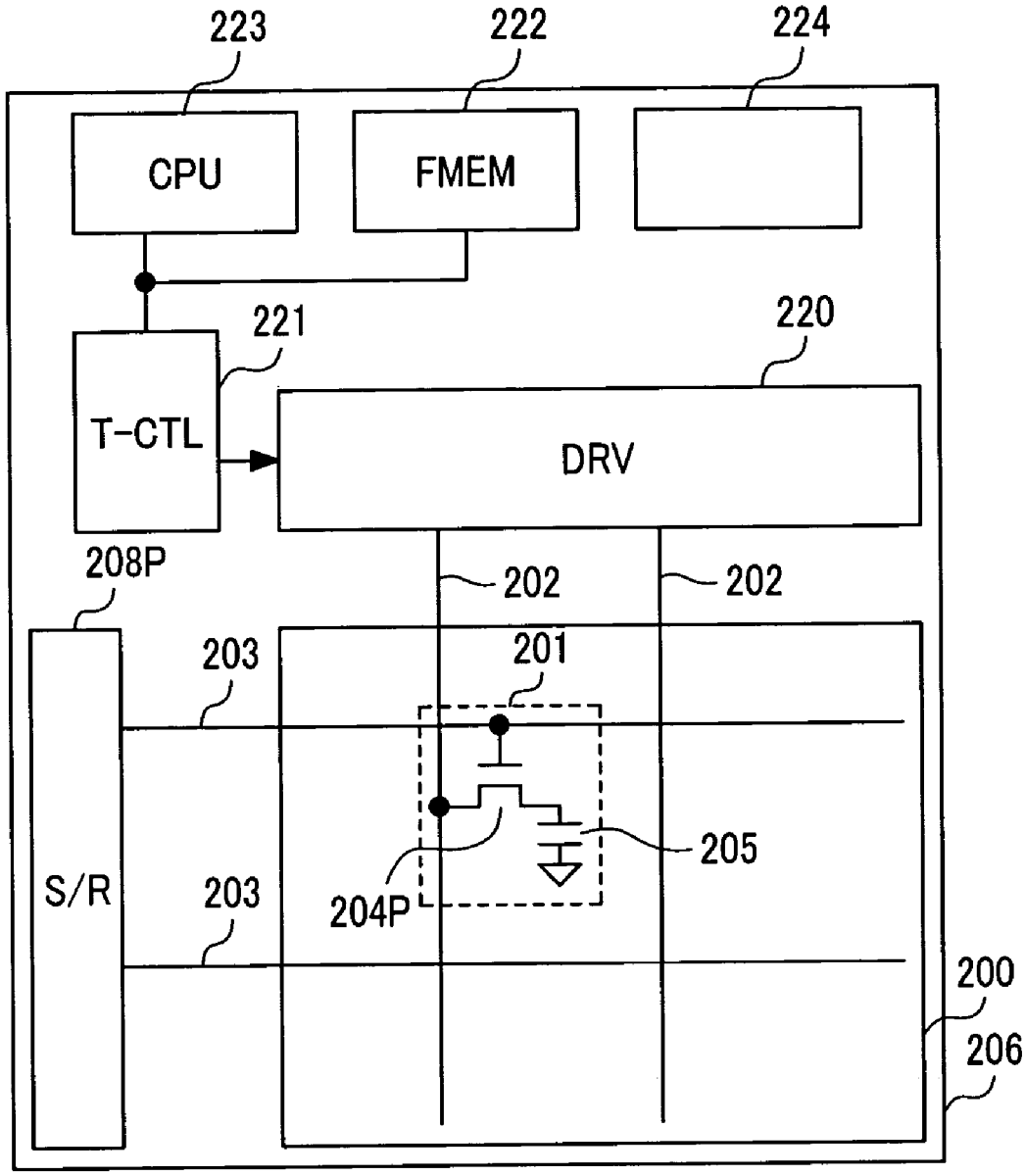
FIG. 8 is a block diagram of an image display device of a third prior art.
Figure 9:
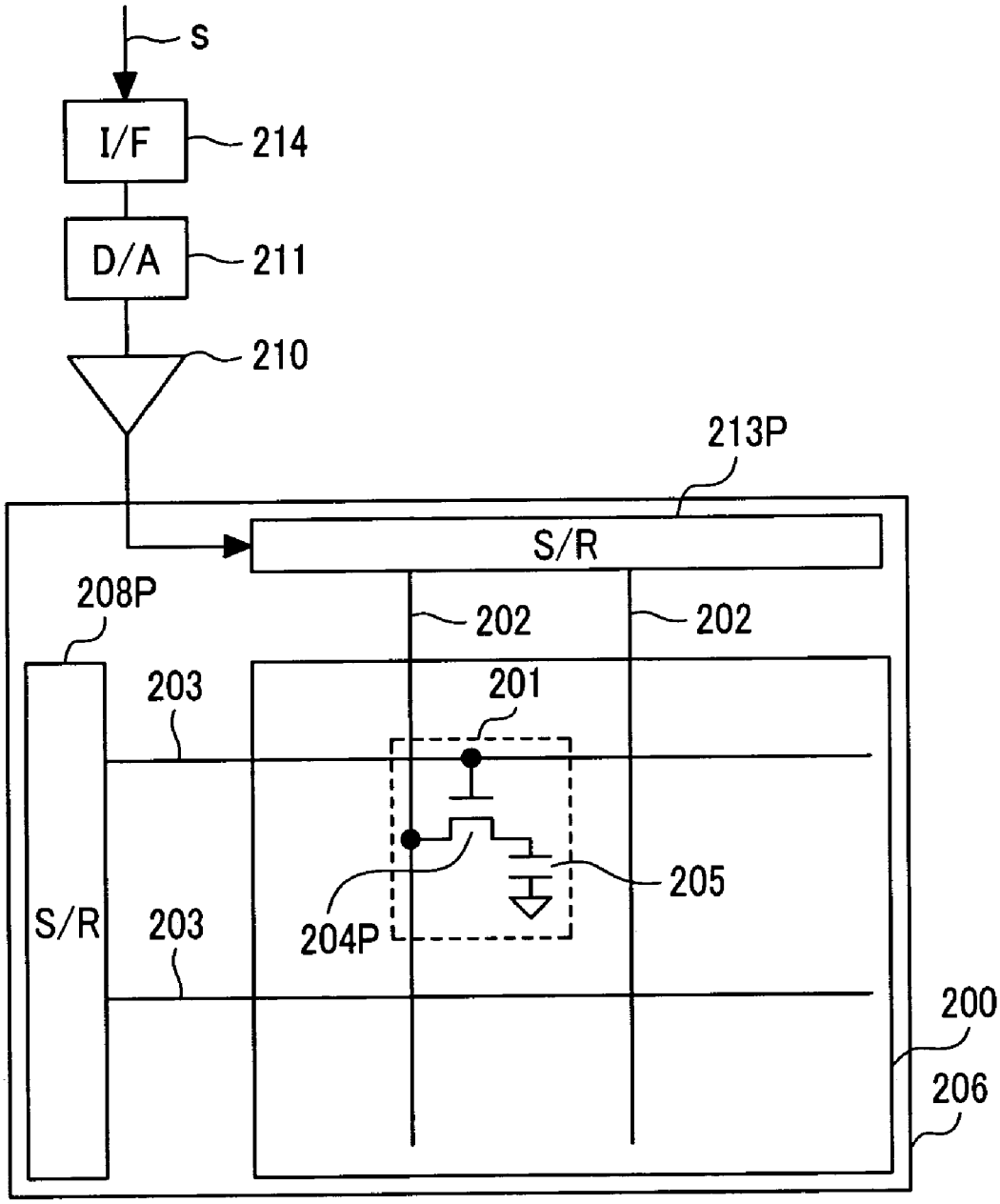
FIG. 9 is a block diagram of an image display device of a fourth prior art.

A fourth embodiment of the image display device of the invention will be described. FIG. 5 is a block diagram of a personal digital assistance showing a fourth embodiment of the invention. Since the general configuration and operation of the fourth embodiment are basically similar to those of the personal digital assistance of the first embodiment described above except that the serial-parallel converter 15 for dividing the buffer circuit 10 into three channels of RGB is not provided.

The differences between the fourth and first embodiments are structures and operations of pixels which will be described hereinbelow.

Pixels 1E are provided in the shape of a matrix in the display area 100, and the signal lines 2 and gate lines 3 are connected to the pixels 1E. Although a number of pixels 1E are provided in the display area 100 in reality, only one pixel is shown in FIG. 5 for simplification of the drawing. The pixel 1E is constructed by the pixel switch 4 formed by a polycrystalline Si-TFT, an organic light-emitting element 52 and, further, a drive TFT 51 for driving the organic light-emitting element 52. The display area 100 is provided on the glass substrate 6.

The operation of the embodiment shown in FIG. 5 will now be described.

The vertical shift register 8 switches the pixel switch 4 in a pixel row to which an image signal voltage is to be written to the on state via the predetermined gate line 3. A predetermined image signal voltage is written to the gate capacitance of the drive TFT 51 of the selected pixel 1E. After that, the drive TFT 51 inputs drive current according to the written image signal voltage to the organic light-emitting element 52 to light the organic light-emitting element 52 with predetermined brightness for a period until the following image signal voltage is applied, thereby displaying a predetermined image in the display area 100.

In the embodiment, the organic light-emitting element 52 is provided in place of the liquid crystal element, so that the personal digital assistance having capability of displaying a high-quality moving image can be realized for the reason that the response speed of the organic light-emitting element is much higher than that of the liquid crystal element. Thus, the invention can provide the personal digital assistance having display quality suitable for receiving and displaying a moving image in digital terrestrial broadcasting.

What is claimed is:

1. An image display device comprising:

a display part constructed by a plurality of pixels provided on an insulating substrate;

display signal voltage writing means including a signal line for applying a display signal voltage to said pixels; and signal voltage generating means for generating said display signal voltage from digital display signal data, wherein said signal voltage generating means includes D/A converting means and impedance converting means for an output voltage of said D/A converting means, said D/A converting means is formed on said insulating substrate, and said impedance converting means is formed on a semiconductor substrate.

2. The image display device according to claim 1, wherein said D/A converting means is constructed by a circuit whose component element is a TFT made of polycrystalline Si.

3. The image display device according to claim 1, wherein said impedance converting means is constructed by a circuit whose component element is a MOS transistor made of single crystal Si.

4. The image display device according to claim 3, wherein said impedance converting means includes a differential amplification circuit having negative feedback.

5. The image display device according to claim 1, wherein said pixel displays an image by modulating optical characteristics of a liquid crystal element in accordance with a display signal voltage.

6. The image display device according to claim 1, wherein said pixel displays an image by modulating a light emission characteristic of a light-emitting element in accordance with a display signal voltage.

7. The image display device according to claim 6, wherein said light-emitting element is an organic light emission diode provided in said pixels.

8. The image display device according to claim 1, wherein said display signal voltage writing means includes scan selecting means for a pixel row in the horizontal direction and scan selecting means for a pixel column in the vertical direction.

9. The image display device according to claim 1, wherein said display signal voltage writing means includes interface means for receiving a command signal from a CPU or a graphic controller, and said interface means is provided on said insulating substrate.

10. The image display device according to claim 1, wherein said display signal voltage wilting means has at least one predetermined supply voltage-generating means, and said supply voltage-generating means is provided on said insulating substrate.

11. The image display device according to claim 1, wherein said display signal voltage writing means includes at least one predetermined supply voltage-generating means, and said supply voltage-generating means is provided on said semiconductor substrate.

12. The image display device according to claim 1, wherein said signal voltage generating means includes display signal data storing means, and said display signal data storing means is provided on said insulating substrate.

13. The image display device according to claim 1, wherein said semiconductor substrate is mounted on an FPC.

14. An image display device comprising:

a display part constructed by a plurality of pixels provided on an insulating substrate;

display signal voltage writing means including a signal line for applying a display signal voltage to said pixels; and signal voltage generating means for generating said display signal voltage from digital display signal data, wherein said signal voltage generating means includes D/A converting means, and impedance converting means for an output voltage of said D/A converting means, each of said D/A converting means and said display part is formed by a circuit whose component element is a TFT, and said impedance converting means is formed by a circuit whose component element is a MOS transistor made of single crystal Si.

* * * * *